US006910675B1

(12) United States Patent
Cox

(10) Patent No.: US 6,910,675 B1
(45) Date of Patent: Jun. 28, 2005

(54) PROGRESSIVE AUTO RAMPS

(76) Inventor: Jerry Cox, 935 Kodiak Pl., Belgrade, MT (US) 59714

( * ) Notice: Subject to any disclaimer, the term of this patent is extended or adjusted under 35 U.S.C. 154(b) by 0 days.

(21) Appl. No.: 10/603,826

(22) Filed: Jun. 26, 2003

Related U.S. Application Data

(60) Provisional application No. 60/394,933, filed on Jul. 11, 2002.

(51) Int. Cl.[7] ..... E02C 3/00
(52) U.S. Cl. ..... 254/1; 254/88
(58) Field of Search ..... 254/88, 1; 188/32; 14/69.5; 248/352

(56) References Cited

U.S. PATENT DOCUMENTS 3,917,226 A * 11/1975 Palmer ..... 254/88
4,427,179 A 1/1984 Price
4,920,596 A 5/1990 Stevens
5,863,026 A 1/1999 Gano et al.

* cited by examiner

*Primary Examiner*—Robert C. Watson
(74) *Attorney, Agent, or Firm*—Patent & Trademark Services, Inc.; Joseph H. McGlynn

(57) ABSTRACT

A ramp for vehicles and a method of using the ramp and the ramp has a plurality of ramp parts which can be progressively assembled to increase the height of the ramp.

2 Claims, 1 Drawing Sheet

PROGRESSIVE AUTO RAMPS

Applicant claims priority of Provisional application Ser. No. 60/394,933, filed Jul. 11, 2002.

BACKGROUND OF THE INVENTION

This invention relates, in general, to auto ramps, and, in particular, to auto ramps with a plurality of ramp parts to increase the height of the ramp.

DESCRIPTION OF THE PRIOR ART

In the prior art various types of devices have been proposed. For example, U.S. Pat. No. 5,863,026 to Gano et al discloses an auto ramp having an extended portion to decrease the angle between the ramp and the ground.

U.S. Pat. No. 4,920,596 to Stevens discloses an auto ramp with a plurality of parts connected together to make a dual level ramp.

U.S. Pat. No. 4,427,179 to Price discloses an auto ramp made from a plurality of pieces all of which are oriented in the same direction. U.S. Pat. No. 3,917,226 to Palmer discloses an auto ramp made from a plurality of parts to raise both the front and rear wheels.

SUMMARY OF THE INVENTION

The present invention is directed to a ramp, for a vehicle, and the ramp has a plurality of ramp parts to progressively increase the height of the ramp.

It is an object of the present invention to provide a new and improved auto ramp.

It is an object of the present invention to provide a new and improved auto ramp which is economical to manufacture.

It is an object of the present invention to provide a new and improved auto ramp which can be quickly assembled and disassembled.

It is an object of the present invention to provide a new and improved auto ramp which can be used with any vehicle.

It is an object of the present invention to provide a new and improved auto ramp which can be used to progressively increase the height of the ramp to any practical height.

These and other objects and advantages of the present invention will be fully apparent from the following description, when taken in connection with the annexed drawings.

One of the disadvantages associated with traditional ramps is many late model cars have bumpers or air dams that are low and that make contact with the conventional single stage ramps before the tires engage the ramps. Another problem with single stage ramps is they have a tendency to "push" or "slide out" as the tires engage them. If a car approaches them too slowly, a rear wheel vehicle will often "spin out". If the vehicle approaches too quickly, there is a chance of overshooting the platform at the top of the ramp. Another disadvantage of the prior art ramps is they are all of a fixed height, and the height can not be adjusted for different conditions. The ramp of the present invention is designed to overcome these disadvantages of conventional car ramps.

DESCRIPTION OF THE PREFERRED EMBODIMENT

Figure 1:
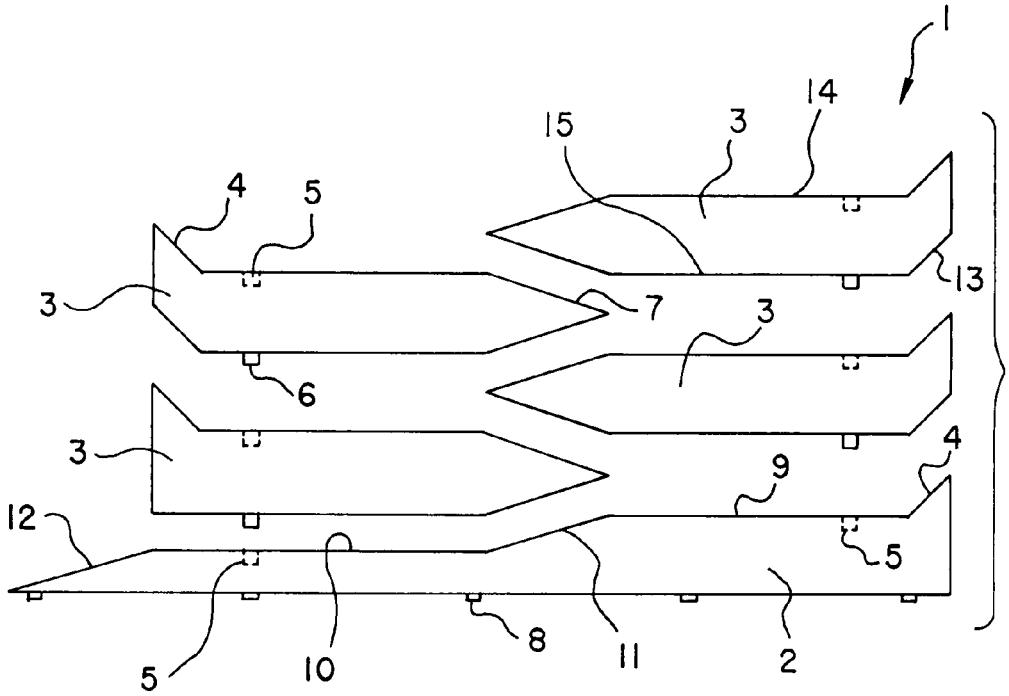
FIG. 1 is side view of the present invention.
Figure 2:
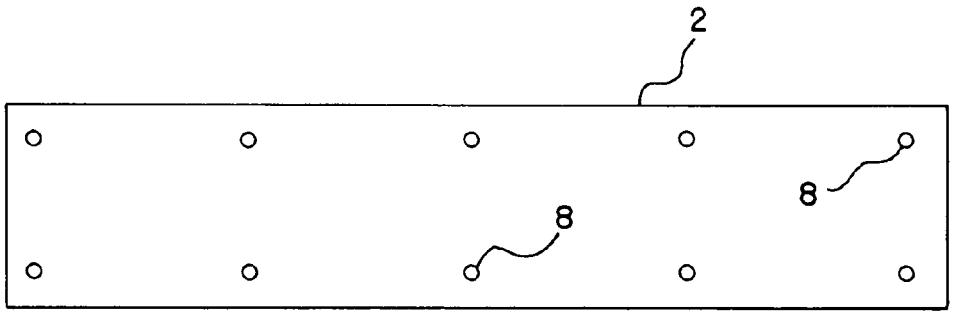
FIG. 2 is a bottom view of the bottom block of the present invention.

Referring now to the drawings in greater detail, FIG. 1 shows an exploded side view of the ramp of the present invention 1. The present invention comprises a bottom block 2. The block 2 has a plurality of antislip rubber legs 8 or other antislip surface attached on the bottom surface of the block by any conventional means. Although rubber is the preferred material for the legs 8, other materials can be used without departing from the scope of the invention. The top surface of block 2 has two portions. A lower portion 10 is joined to a higher portion 9 by a tapered transition section 11. One end of the block 2 has a second transition section 12 between the ground, that the block 2 will rest on, and the lower portion 10. The opposite end of block 2 has a safety stop 4 which rises above the surface of higher portion 9, for a purpose to be explained later.

As shown in FIG. 1, a plurality of upper blocks 3 are progressively placed on top of the lower block 2 to increase the height of the ramp. Although four upper blocks 3 are shown in the drawings, it should be understood that more or fewer blocks 3 can be used without departing from the scope of the invention.

Each block 3 has an upper 14 and lower surface 15, an aperture 5 in the upper surface and an alignment pin 6 on the lower surface. When the blocks 3 are assembled, as will be explained below, the pins 6 of one block 3 will be inserted into the apertures 5 in another block 3 to keep the blocks 3 in position. The lower block 2 has apertures 5 to receive pins 6 on two of the upper blocks 3 for the same reason. It should be noted that while only a single aperture 5 and pin 6 is shown on each block, this is merely for illustrational purposes, and any number of apertures 5 and pins 6 can be used on each block.

Each block 3 also has a tapered section 7 on one end and a safety stop 4 on an opposite end. Each block 3 has a tapered section 13 adjacent the bottom surface of the block which fits against the stop 4 on an adjacent block 3 to allow the blocks to nest.

In order to use the present invention, a user would position the bottom block 2 in front of the front tires of a vehicle. Then, the user would pull the car onto the block 2 until the front wheels hit the stop 4 and and the front wheels rest solely on portion 9 of block 2. At this point the wheels would not be resting on any part of portion 10 of block 2. Next, a first block 3 would be placed on portion 10 of block 2 with the pin(s) 6 engaged in aperture(s) 5 to prevent the blocks from moving with respect to each other. The car would now be backed up until the front tires are resting on the top surface of block 3 which was placed on portion 9 of block 2 until the tires engage the rest 4 on block 3. At this point no part of the tires will be resting on portion 9 of block 2. If the user wants the car to be raised higher, he/she would then place a second block 3 onto surface 9 of block 2. The car will now be moved forward onto the top surface of the second block 3 until the tires are resting solely on the top surface of the second block 3 and against the stops 4. This process can be repeated using additional blocks 3 until the car is at the desired height.

Although the Progressive Auto Ramps and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A method of using a ramp to raise wheels of a vehicle, and consequently the vehicle itself, off of the ground, said ramp comprising:

a first ramp portion, said first ramp portion having a top surface and a bottom surface, a first end and a second end, said top surface having a first section and a second section, said first section of said top surface being lower in height than said second section, at least one second ramp portion, said at least one second ramp portion having a top surface and a bottom surface, and wherein said method comprises:

positioning said first ramp portion adjacent tires of a vehicle, moving said vehicle until said tires are on said second section of said top surface, placing at least one second ramp portion on said first section of said first ramp portion, moving said vehicle until said tires are resting on said at least one second ramp portion, and wherein the method further comprises:

adding an additional second ramp portion by placing said additional second ramp portion on said second section of said top surface of said first ramp portion, moving said vehicle until said tires are resting on said additional second ramp portion.

2. The method of using a ramp as claimed in claim 1, wherein the method further comprises:

adding a second additional second ramp portion by placing said second additional second ramp portion on said at least one second ramp portion, moving said vehicle until said tires are resting on said second additional second ramp portion.

* * * * *